US005899622A

United States Patent [19]

Gueret

[11] Patent Number: 5,899,622

[45] Date of Patent: May 4, 1999

[54] APPLICATOR FOR APPLYING LIQUID OR SEMI-LIQUID PRODUCT, AND APPLICATOR ASSEMBLY USING SUCH AN APPLICATOR

[75] Inventor: Jean-Louis H. Gueret, Paris, France

[73] Assignee: L'Oreal, Paris, France

[21] Appl. No.: 08/922,027

[22] Filed: Sep. 2, 1997

[30] Foreign Application Priority Data

Sep. 2, 1996 [FR] France ..... 96 10688

[51] Int. Cl.[6] ..... A46B 11/00

[52] U.S. Cl. ..... 401/122; 401/129

[58] Field of Search ..... 401/122, 129, 401/52; 132/218

[56] References Cited

U.S. PATENT DOCUMENTS

| | | | |
|---|---|---|---|
| 3,951,157 | 4/1976 | Idec | 401/122 |
| 4,403,624 | 9/1983 | Montgomery | 401/122 |
| 4,772,148 | 9/1988 | Buschemeyer . | |
| 5,324,128 | 6/1994 | Gueret . | |
| 5,345,644 | 9/1994 | Gueret | 132/218 |
| 5,490,737 | 2/1996 | Gueret | 401/122 |

FOREIGN PATENT DOCUMENTS

| | | |
|---|---|---|
| 0 244 156 A1 | 11/1987 | European Pat. Off. . |
| 0354823 A1 | 2/1990 | European Pat. Off. . |
| 0 627 182 A1 | 12/1994 | European Pat. Off. . |
| 0693263 A1 | 1/1996 | European Pat. Off. . |
| 1.539.311 | 9/1968 | France . |
| 2.085.208 | 12/1971 | France . |
| 2.603.780 | 3/1988 | France . |

*Primary Examiner*—David J. Walczak

*Attorney, Agent, or Firm*—Oblon, Spivak, McClelland, Maier & Neustadt, P.C.

[57] ABSTRACT

An applicator for applying a liquid or semi-liquid product to a surface, the applicator being of substantially longitudinal or elongate shape, including a central core defining a structure which is porous so as to allow the applicator to be loaded by capillarity internally; and a covering of flocking arranged all around the central core, at least over part of its length, so as to allow the applicator to be loaded by capillarity externally. The invention also relates to an applicator assembly using an applicator according to the invention.

40 Claims, 3 Drawing Sheets

APPLICATOR FOR APPLYING LIQUID OR SEMI-LIQUID PRODUCT, AND APPLICATOR ASSEMBLY USING SUCH AN APPLICATOR

BACKGROUND OF THE INVENTION

1. Field of the Invention

The invention relates to a device for applying a liquid or semi-liquid product, such as a cosmetic product, to a surface. By way of example, the invention can be used for applying lipstick, nail varnish, mascara, anti-wrinkle care cream, etc., but can also be used for applying non-cosmetic products, such as adhesive.

2. Discussion of the Background

Conventionally, especially for eyeliners used in the field of cosmetics, the product is applied mainly using two techniques.

In a first technique, the applicator has a felt tip with longitudinal parallel fibers. Such an applicator is described, for applying freckles, in French Patent 2,085,208 and mainly comprises a reservoir made, for example, of plastic, and closed at one of its ends by a leaklight cap. The reservoir contains a felt wick. The end of the reservoir remote from the cap has a conical shape and tightly grips a dispensing tip of which one end is in contact with the wick and the other end is outside the reservoir for applying the product to the surface to be treated.

The drawback of this type of applicator relates mainly to its excessive product retention and also to its lack of gentleness. This is particularly unfortunate for applicators of the eyeliner type. Furthermore, this type of applicator is not well suited to the application of compositions which contain pigments of excessively large size.

According to a second known technique, the product, in the case of an eyeliner, is applied using a pen called a flocked pen. By way of example, such a pen is in the form of an elongate conical applicator tip with a pointed extremity. The tip may be molded from thermoplastic, for example polyurethane. According to this technique the surface of the tip is partially, or even completely, covered with flocking consisting of polyamide, rayon or cotton fibers with a diameter of approximately 70 mm and a length of approximately 1.2 mm.

The latter technique, even though it gives the possibility of applying make-up gently to provide an attractive look, does however have the drawback of lacking autonomy.

SUMMARY OF THE INVENTION

One of the objects of the present invention is to produce a device for applying a liquid or semi-liquid product to a surface, which does not have the drawbacks mentioned above with reference to the devices discussed earlier.

Another object of the present invention is to produce an applicator for a cosmetic product, which is gentle on the face and gives an autonomous line while at the same time dispensing with some of the product retention caused by fibers of the felt type.

A further object of the present invention is to produce an assembly for applying a cosmetic product, for example, using an applicator tip according to the invention.

Other objects will be revealed in greater detail in the description which follows.

According to a first aspect of the invention, these objects are achieved by means of an applicator for applying a liquid or semi-liquid product to a surface, which includes:

a) a core of elongate shape having a longitudinal axis and defining a structure which is porous so as to allow the applicator to fill by capillarity internally, the core having a free end; and b) a covering of flocking arranged all around the central core, at least close to the free end, so as to allow the applicator to fill by capillarity externally.

Thus, according to the invention, for example in the case of an eyeliner, with a core in the form of a felt tip, because the flocking is present the product is directed towards the tip, as it would be in the conventional felt tips discussed earlier. The result of this is that it is possible for the applicator to be used not only on the tip, but also on the side to obtain lines of varying thickness, or for applying the product in forms other than a line. Once the initial load of product retained in the flocking has been used up the flocking, a load of product is supplied afresh via the porous part, which greatly increases its application autonomy.

The core is preferably of rigid to semi-rigid consistency, that is to say one that does not deform appreciably under normal conditions of pressure for an application. Thus the product is applied to the surface to be treated, either mainly via the internal structure (porous structure) or mainly via the external structure (flocking) or via both, which gives very great flexibility in methods of application.

Advantageously, the cross-section of the core is substantially symmetrical about the longitudinal axis.

In the present invention, the porous structure is understood to be any structure capable of absorbing product to some depth (by capillarity or some other equivalent mechanism).

Advantageously, the central core consists of a fibrous structure (felt, pencil-brush, etc.), the fibers or bristles of which it is composed being directed substantially along the axis of the applicator, while the covering of flocking is formed of fibers directed more or less at right angles to the axis of the applicator. This structure advantageously enables the production of an applicator which, on the one hand, allows product to be applied by bringing the free end of the applicator into contact with the surface to be treated (in the form of a fine line, for example made with the tip of the fibers) and, on the other hand, allows the product to be applied by bringing the flocking, especially near the free end, into contact with the surface to be treated (by inclining the applicator to a greater degree relative to the surface) so as to allow a less localized application of product (in the form of a thicker line, for example).

As an example, the porous structure consists of a collection of longitudinally extending fibers (nylon, polyethylene, polyethylene terephthalate). Advantageously, bonds are formed between the fibers over at least part of the length of the core of the applicator, so as to secure the fibers or bristles together, for example at one end of the applicator. Such bonds may advantageously be obtained by welding (thermoplastic bonds for example). Also other means, of the bonding type, can for example be employed to secure the fibers or bristles.

The porous structure may consist of a brush with bristles made of polyester, for example.

In an alternative, the central core consists of a plastic (polyethylene), elastomer or metal sinter.

Advantageously, the flocking consists of polyamide, rayon or cotton fibers, or of a mixture of such fibers. Such fibers may have different lengths and/or types and/or diameters and/or hardness.

A second aspect of the invention relates to an assembly for applying a liquid or semi-liquid product, including:

a) an element to be held, and a wand having a first end secured to an applicator intended for picking up product and applying this product to a surface to be treated, and a second end secured to the element to be held; and b) a reservoir containing the product and equipped with a neck designed to detachably accommodate the element to be held, the applicator assembly being characterized in that it employs an applicator according to the first aspect of the invention.

Advantageously too, the applicator assembly further comprises an annular wringing member fixed to the neck of the reservoir and through which the wand passes, this member being capable of wringing out the wand and/or the applicator.

According to a first alternative form, the wringing member has at least one transverse slit to allow the applicator to be filled with product by capillarity.

In a second alternative, the wringing member is shaped like a thimble with a central passage, and the internal surface of which may be at least in part covered with a covering of flocking.

As an example, the liquid or semi-liquid product is a mascara or a nail varnish.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1A:
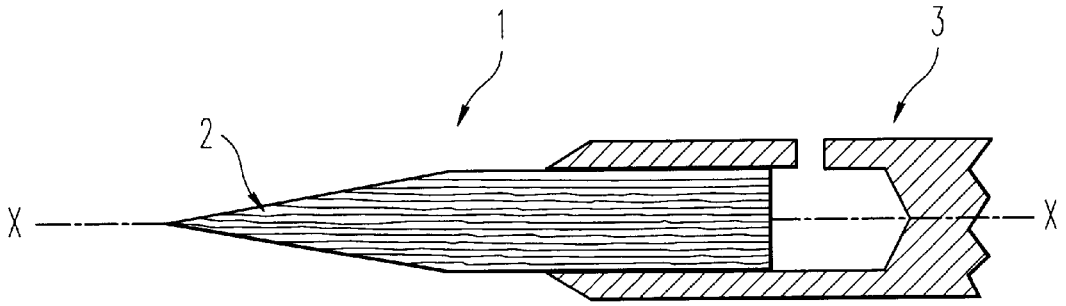
FIG. 1A PRIOR ART
FIGS. 1*a* and 1*b* are views in longitudinal section of two conventional applicators.

FIG. 1*a* depicts a conventional felt tip of the type used, for example, in French Patent 2,085,208 discussed in the introduction to this application. The felt tip 1 is in the form of a bundle 2 of fibers arranged more or less parallel to the axis of the applicator and mounted securely on a wand 3 which may at its other end be connected to a handle or any other equivalent device to be held. The felt is cut in such a way as to have a relatively fine point to allow the product to be applied as a fine line.

Figure 1B:
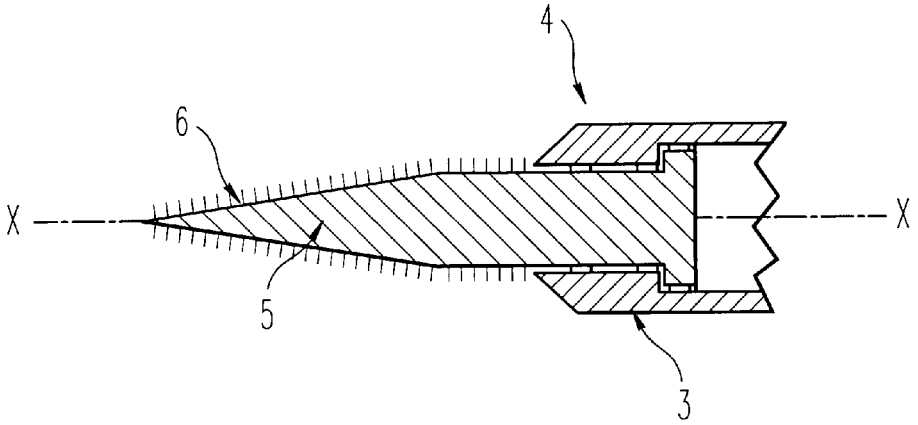
FIG. 1B PRIOR ART

FIG. 1*b* depicts a conventional flocked pen 4 as discussed in the discussion of the background. It has a solid molded core 5. Typically, the core of the pen is made of a flexible or semi-rigid elastomeric material with a Shore A hardness of the order of 25 to 40, chosen from the group consisting of thermoplastics, thermoplastic elastomers, natural and synthetic rubbers. The flexibility of the pen depends on the choice of material, and on the shape of the pen. The covering of the pen consists of a covering of flocking obtained using natural or synthetic fibers 6, such as fibers of cotton, rayon, polyamide, polyester, etc. In general, these fibers 6 have a diameter of approximately 50 $\mu$m to 250 $\mu$m. Typically, their length is approximately 0.3 mm to 2 mm. As may be seen, the fibers forming the flocking are directed more or less at right angles to the axis X of the pen. In the same way as for the felt-tip pen of FIG. 1*a*, the pen is mounted on a wand 3 which may be connected to means (not depicted) to be held.

The present invention stems from the observation that it may be advantageous to produce an applicator which offers both the advantages of applicators of the "felt-tip pen" type (e.g. fineness of the line and better moisture retention, thus avoiding coagulation problems) and the advantages of applicators of the "flocked pen" type (e.g. gentleness of application, brightness of the line, etc.) while at the same time minimizing the drawbacks inherent with these two techniques (high retention with the felt-tip pen which produces a matt and transparent line, the sometimes insufficient autonomy of the flocked pen, etc.).

Figure 2A:
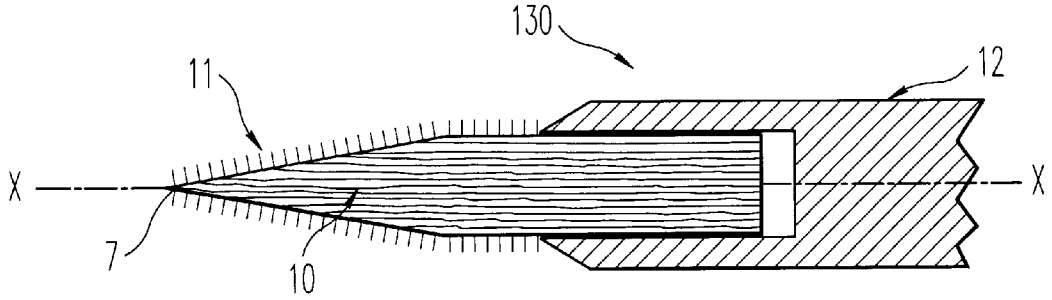
FIGS. 2*a*–2*d* are views in longitudinal section of four preferred embodiments of the applicator according to the invention.

FIG. 2*a* illustrates a view in longitudinal section of a first embodiment of the applicator 130 according to the invention. In this first embodiment, the core 10 of the applicator consists of a felt tip (porous structure) having a free end 7, and having fibers directed parallel to the axis of the applicator and around which tip, over at least part of its length, there is a flocked covering of fibers 11 directed more or less at right angles to the axis of the applicator. The flocking consists of polyamide, rayon or cotton fibers or of a mixture of such fibers. The size of the fibers forming the flocking may range from the size of a very fine powder up to 2 mm.

The technique employed for applying this fibrous covering consists, for example, in coating the surface to be covered with a monomer liquid adhesive, either by dipping or by spraying the adhesive with a spray gun. In particular, in cases where the entire surface of the central core is flocked, it is necessary to ensure that the adhesive forms a permeable or porous layer so that it does not cancel the ability of the central core to absorb product to some depth and to re-release it at the desired points. Advantageously however, the porous structure is not coated with adhesive over its entire surface. When it is deposited on a brush, after drying the adhesive stiffens the structure of the brush which then may, depending on the adhesive employed, have a flexible to semi-rigid, or even rigid consistency.

The thus impregnated applicator is then transferred into a powder of particles the length of which is chosen to suit the desired amount of product that can be loaded or the fineness of the line. These particles, which are electrostatically charged, are suspended in air and are deposited on the impregnated surface of the applicator by electrostatic attraction. Thus, in most cases these particles direct themselves so that they are more or less at right angles to the impregnated surface. Advantageously, the thus covered element is then placed in an oven in order to polymerize the monomer adhesive. After cooling, any excess particles are sucked away.

As depicted, the applicator 130 may be mounted on a wand 12 which itself has means allowing it to be mounted on the reservoir of an applicator assembly which will be described in greater detail hereinbelow. It should, however, be noted that the applicator can be mounted on the wand 12 from the inside or from the outside.

As discussed earlier, when the applicator is dipped in the product it becomes filled with product on the one hand by capillarity externally thanks to the flocking and on the other hand by capillarity internally thanks to the fibers which form the core of the applicator. Thus the fibers of the core of the applicator constitute a miniature reserve of product which is drawn in by the flocking by capillarity once the initial fill of product present on the fibers at right angles to the flocking has been applied.

When such an applicator is being used, for example to produce a line, the applicator is inclined to a greater or, lesser extent relative to the surface to be treated, depending on the thickness of the desired line. The line is thus drawn either only by the tip of the applicator in order to produce a fine line, or by the tip together with the flocking arranged all around it, so as to produce a thicker line.

Materials other than felt may be employed according to the present invention to produce the porous structure of the applicator. By way of example, the central core is made, like a brush, of a collection of longitudinally extending fibers (nylon, polyethylene, polyester, polyethylene terephthalate, acrylic, etc.). The end remote from the tip may have a region 50 of welding or adhesive coating where the fibers are joined, for example by thermoplastic bonds. Furthermore, and as mentioned earlier, in the case of a brush the bristles are also held grouped together, especially where the flocking is situated, by the layer of adhesive needed for applying the flocking.

Figure 2B:
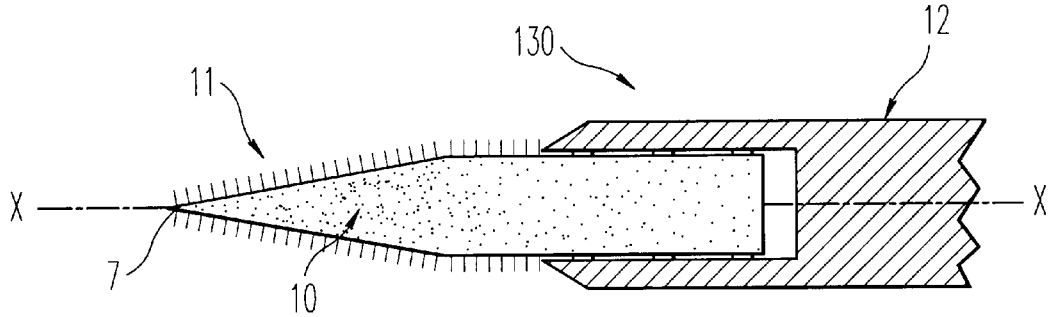

In an alternative illustrated in FIG. 2*b*, the core of the applicator is made of sintered ceramic, a plastic (polyethylene, polyvinyl, PVC, etc.), an elastomer a metal or of a sintered polyurethane which may be porous, whereby product is thus loaded by absorption over the entire surface of the applicator.

Figure 2C:
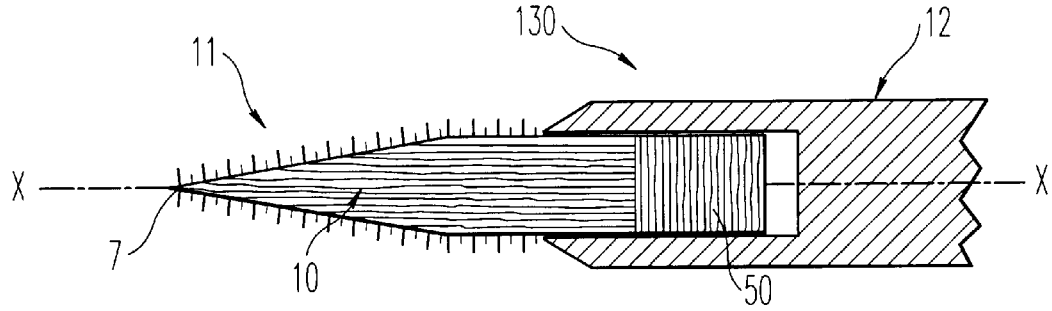
Figure 2D:
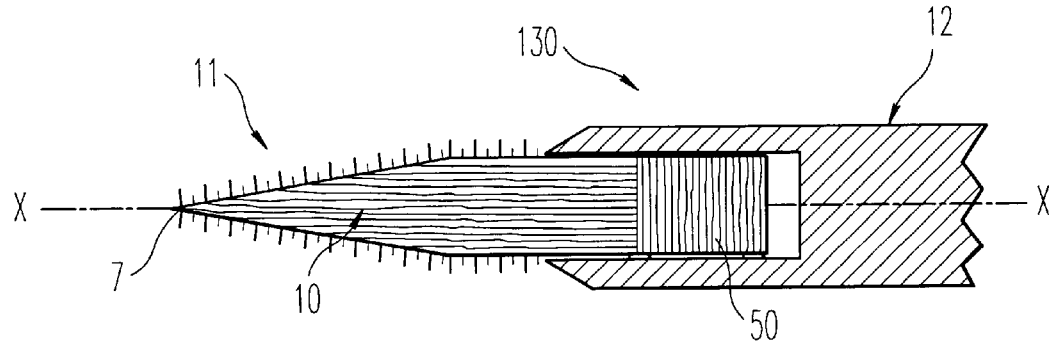

In the embodiment of FIG. 2*c*, the flocking consists of a mixture of fibers of different lengths. Likewise, the flocking may be produced from fibers of different type and/or diameter and/or hardness, thus making it possible to influence the gentleness of application, the external capillarity of the applicator, the degree of retention, or the amount of product applied. In a particularly beneficial embodiment, use is made of a mixture of fibers of different diameters and different lengths. This last embodiment is illustrated in FIG. 2*d*.

The embodiments discussed in the present description relate essentially to a pen with the shape of a point. It is quite obvious that the invention is not restricted to this specific shape and is targeted in general at any applicator of more or less longitudinal (elongate) shape which may or may not be faceted.

Figure 3:
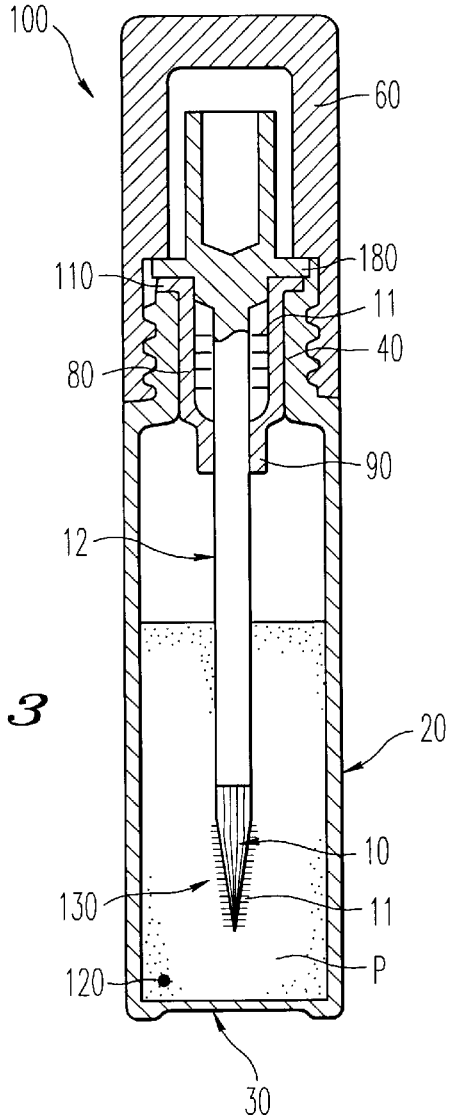
FIG. 3 illustrates one embodiment of an applicator device employing the applicator according to the invention.

FIG. 3, to which reference is now made, illustrates by way of example an applicator assembly 100 on which the applicator according to the invention can be mounted. It comprises a reservoir 20 of cylindrical shape closed by a bottom 30. On its end remote from the bottom 30, the reservoir is extended by a neck 40 with a diameter smaller than that of the reservoir. The neck 40 has an external screw thread which interacts with an internal screw thread of a cylindrical sleeve 60 which serves as an element for holding an applicator 130 permanently immersed in the product P when the sleeve 60 is screwed onto the neck 40 of the reservoir. This product is, for example, mascara or a nail varnish. Advantageously, there is a ball 120 inside the reservoir to allow the composition to be homogenized, by shaking before use.

Fixed into the sleeve 60 is a wand 12 which has a radial extension 180 on the inside of the sleeve, the diameter of which is more or less identical to the outside diameter of the neck 40. The applicator 130 supported by one of the ends of the wand can be molded with it and then flocked. The applicator 130 may thus be snap-fitted, glued or welded into the wand 12.

Inserted in the neck is a wringing member 80, for example in the shape of a thimble, and which on the adjacent side the reservoir has a circular wringing lip 90. On the opposite side, this thimble 80 has a radially outwardly extending collar 110 thus resting on the neck 40 of the reservoir. When the assembly 100 is put together, the collar 110 rests against the radial extension 180 of the wand, thus acting as a seal. The wringing member 80 is made of an elastomeric or thermoplastic material, which may be selected from among thermoplastic elastomers and natural or synthetic rubbers.

The wand has a diameter of approximately 3 mm. Its free end carries an applicator according to the invention which may be fixed to the wand 12 by thermal welding, bonding or any other appropriate means.

The wringing member 80 may have the wand passing through it and be arranged in such a way as to wring the wand and/or the applicator. Alternatively, the wringing member may have the shape of a thimble with a central passage and may have its internal surface covered, at least in part, with a covering of flocking. Typically, such a thimble is closed at one of its ends and has a lateral orifice to allow the applicator to fill with product.

Figure 4:
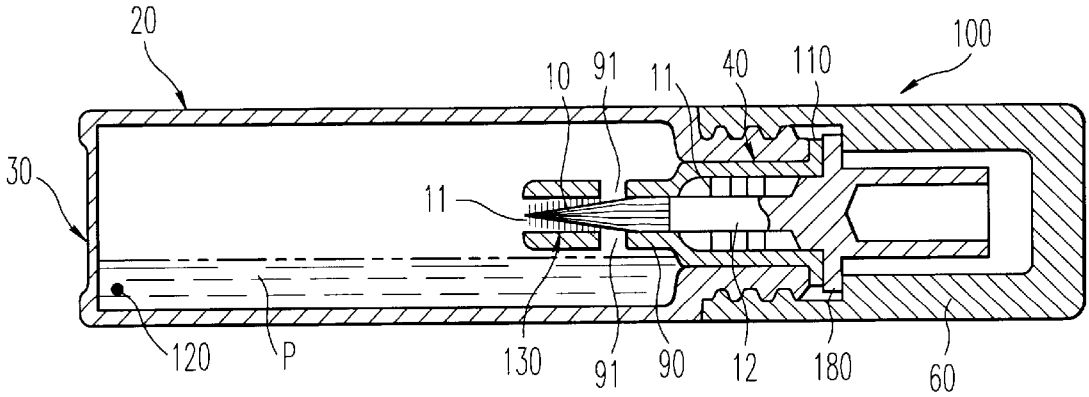
FIG. 4 diagrammatically illustrates an alternative form of the device depicted in FIG. 3.

FIG. 4 diagrammatically depicts an alternative form of the device in FIG. 3, in which use is made of a long wringing member 90 which has at least one slit or orifice 91 to allow the applicator to fill by capillarity. The other parts of the device are identical to those of the device of FIG. 3, and therefore require no additional detailed description.

It is obvious that these devices on which the applicator according to the invention can be employed are given merely by way of illustration. Again by way of example, the applicator according to the invention can be employed on devices like those described in U.S. Pat. No. 5,324,128, French Patent 2,603,780 or European Patent 354,823.

Thus the invention which has just been described with reference to preferred embodiments is particularly advantageous because it provides an applicator which can be used not only on the tip but also, thanks to the flocking, on the side so as to obtain, for example, lines of varying thickness. The autonomy of the flocking is increased according to the invention because the flocking is supplied by the felt reservoir when the initial dose present on the flocking is spent. Another advantage of this type of applicator also stems from the fact that, if necessary, it can absorb any excess product from the capillary loading system, thus avoiding excessive soiling of the wand. What is more, the combination of internal capillarity/external capillarity, for example as obtained using a flocked brush or felt, is very particularly advantageous because it allows better moisture retention. For some formulations, like those containing at least one pseudo-latex, this makes it possible to avoid the product coagulating, something which might happen if the user forgets to return the applicator to its airtight reservoir.

The foregoing description deals with preferred embodiments of the invention. It is obvious that alternative forms can be added thereto without departing from the spirit of the invention as claimed hereafter.

What is claimed as new and desired to be secured by Letters Patent of the United States is:

1. Applicator for applying a liquid or semi-liquid product to a surface, which comprises:

a central core of an elongate shape along a longitudinal axis and defining a porous structure allowing loading of said applicator by capillarity internally, said core having a free end; and a covering of flocking located around the central core, at least in proximity with said free end, said flocking allowing loading of said applicator by capillarity externally wherein the central core comprises one of a sintered plastic core, an elastomeric core, a ceramic core and a metal core.

2. An applicator according to claim 1, wherein the central core comprises one of a rigid and semi-rigid core.

3. An applicator according to claim 1, wherein the central core comprises a fibrous structure having fibers which are substantially directed along the longitudinal axis of the applicator, wherein the covering of flocking comprises fibers directed at substantially right angles to the axis of the applicator.

4. An applicator according to claim 1, wherein the central core comprises fibers arranged longitudinally in the form of a brush.

5. An applicator according to claim 4, wherein the longitudinal fibers are joined together over at least part of the length portion of a core of the applicator.

6. An applicator according to claim 5, wherein the fibers are joined together by one of bonding and welding.

7. An applicator according to claims 4, 5, or 6, wherein said fibers comprise one of nylon, polyethylene and polyester fibers.

8. An applicator according to claim 1, wherein the central core comprises one of sintered polyethylene and a sintered polyurethane.

9. An applicator according to claim 1, wherein the flocking comprises one of polyamide, rayon, cotton, polyester and acrylic fibers.

10. An applicator according to claim 1, wherein the flocking comprises a mixture of fibers, said fibers being of differing types and/or lengths and/or hardness and/or diameters.

11. An assembly for applying one of a liquid and semi-liquid product, which comprises:

an applicator for picking up the product and applying the product to a surface to be treated which comprises a central core of an elongate shape along a longitudinal axis and defining a porous structure allowing loading of said applicator by capillarity internally, said core having a free end, a covering of flocking located around the central core at least in proximity with said free end, said flocking allowing loading of said applicator by capillarity externally;

a holding element;

a wand having a first end secured to an applicator, a second end of the wand being secured to the holding element;

a reservoir containing said product and equipped with a neck detachably accommodating the holding element; and an annular member for wringing or metering the product, said annular member being fixed to the neck of the reservoir and wringing out at least one of the wand and the applicator wherein the central core comprises one of a sintered plastic core, an elastomeric core, a ceramic core and a metal.

12. An applicator assembly according to claim 11, wherein the wringing member has at least one transverse slit allowing said applicator to be filled by capillarity.

13. An applicator assembly according to claims 11 or 12, wherein said wringing member is thimble shaped with a central passage.

14. An applicator assembly according to claim 13, wherein an internal surface of the thimble is covered, at least in part, with a covering of flocking.

15. An applicator assembly according to claim 14, wherein the thimble is closed at an end portion thereof and has a lateral orifice allowing the applicator to be filled with product.

16. An assembly according to claim 11, wherein said one of said liquid and semi-liquid product comprises one of a mascara, a nail varnish and an eyeliner.

17. An applicator according to claim 11, wherein the central core comprises one of a rigid and semi-rigid core.

18. An applicator according to claim 11, wherein the central core comprises a fibrous structure having fibers which are substantially directed along the longitudinal axis of the applicator, wherein the covering of flocking comprises fibers directed at substantially right angles to the axis of the applicator.

19. An applicator according to claim 11, wherein the central core comprises fibers arranged, longitudinally in the form of a brush.

20. An applicator according to claim 19, wherein the longitudinal fibers are joined together over at least part of the length portion of a core of the applicator.

21. An applicator according to claim 20, wherein the fibers are joined together by one of bonding and welding.

22. An applicator according to claims 19, 20 or 21, wherein said fibers comprise one of nylon, polyethylene and polyester fibers.

23. An applicator according to claim 11, wherein the central core comprises one of a sintered polyethylene and a sintered polyurethane.

24. An applicator according to claim 11, wherein the flocking comprises one of polyamide, rayon, cotton, polyester and acrylic fibers.

25. An applicator according to claim 11, wherein the flocking comprises a mixture of fibers, said fibers being of differing types and/or lengths and/or hardness and/or diameters.

26. Applicator for applying a liquid or semi-liquid product to a surface, which comprises:

a central core of an elongate shape along a longitudinal axis and defining a porous structure allowing loading of said applicator by capillarity internally, said core having a free end; and a covering of flocking located around the central core, at least in proximity with said free end, said flocking allowing loading of said applicator by capillarity externally wherein the central core comprises a fibrous structure having fibers which are substantially directed along the longitudinal axis of the applicator, and wherein the covering of flocking comprises fibers directed at substantially right angles to the axis of the applicator.

27. An applicator as claimed in claim 26, wherein the central core comprised fibers arranged longitudinally in the form of a brush.

28. An applicator according to claim 26 wherein the longitudinal fibers are joined together over at least part of the length portion of a core of the applicator.

29. An applicator according to claim 28, wherein the fibers are joined together by one of bonding and welding.

30. An applicator according to claim 26, wherein said fibers comprise one of nylon, polyethylene and polyester fibers.

31. An applicator according to claim 26, wherein the central core comprises one of a sintered, polyethylene and a sintered polyurethane.

32. An applicator according to claim 26, wherein the flocking comprises one of polyamide, rayon, cotton, polyester and acrylic fibers.

33. An applicator according to claim 26, wherein the flocking comprises a mixture of fibers, said fibers being of different types and/or lengths, and/or hardness and/or diameters.

34. An assembly for applying one of a liquid and a semi-liquid product, which comprises:

an applicator for picking up the product and applying the product to a surface to be treated which comprises a central core of an elongate shape along a longitudinal axis and defining a porous structure allowing loading of said applicator by capillarity internally, said core having a free end, a covering of flocking located around the central core at least in proximity with said free end, said flocking allowing loading of said applicator by capillarity externally;

a holding element;

a wand having a first end secured to said applicator, a second end of the wand being secured to the holding element;

a reservoir containing said product and equipped with a neck accommodating the holding element; and an annular member for wringing or metering the product, said annular member being fixed to the neck of the reservoir and wringing out at least one of the wand and the applicator wherein the central core comprises a fibrous structure having fibers which are substantially directed along the longitudinal axis of the applicator and wherein the covering of flocking comprises fibers directed at substantially right angles to the axis of the applicator.

35. An applicator according to claim 34, wherein the wringing member has at least one transverse slit allowing said applicator to be filled by capillarity.

36. An applicator according to claim 34, wherein said wringing member is thimble-shaped with a central passage.

37. An applicator assembly according to claim 34, wherein an internal surface of the thimble is covered, at least in part, with a covering of flocking.

38. An applicator according to claim 37, wherein the thimble is closed at one end portion thereof and has a lateral orifice allowing the applicator to be filled with the product.

39. An assembly according to claim 34, wherein said one of said liquid and semi-liquid product comprises one of a mascara, a nail varnish and an eye liner.

40. An applicator according to claim 34, wherein the central core comprises one of a rigid and a semi-rigid core.

* * * * *